US007350246B1

(12) United States Patent
Smith et al.

(10) Patent No.: US 7,350,246 B1
(45) Date of Patent: Apr. 1, 2008

(54) BATHROOM LEAK DAMAGE PREVENTION APPARATUS

(76) Inventors: Jerry D. Smith, 11336 Stoeppelwerth Dr., Indianapolis, IN (US) 46229; Jennifer M. Smith, 11336 Stoeppelwerth Dr., Indianapolis, IN (US) 46229

( * ) Notice: Subject to any disclaimer, the term of this patent is extended or adjusted under 35 U.S.C. 154(b) by 307 days.

(21) Appl. No.: 11/281,979

(22) Filed: Nov. 18, 2005

(51) Int. Cl.
*E03C 1/00* (2006.01)
*E03C 1/042* (2006.01)

(52) U.S. Cl. ..... 4/671; 4/672; 4/679; 4/695

(58) Field of Classification Search ..... 4/567, 4/568, 601, 671–675, 679, 695
See application file for complete search history.

(56) References Cited

U.S. PATENT DOCUMENTS 3,978,529 A * 9/1976 Krafft ..... 4/695
4,589,446 A 5/1986 Allen
5,124,109 A 6/1992 Drossbach
5,321,860 A * 6/1994 Steinhardt et al. ..... 4/601
5,735,551 A 4/1998 Whitman et al.
6,067,670 A 5/2000 Eddy et al.
6,546,572 B2 4/2003 Demonet
6,775,866 B1 8/2004 Martir et al.

* cited by examiner

*Primary Examiner*—Tuan Nguyen
(74) *Attorney, Agent, or Firm*—Donald R. Schoonover

(57) ABSTRACT

An apparatus for preventing water leak damage from a bath fixture, the apparatus comprising a first side wall, a second side wall, a first end wall, a second end wall, a top wall, a bottom wall sloping downwardly to an outlet wherein the first and second side walls, the first and second end walls, the top wall, and the bottom wall define a compartment therebetween and wherein the water source pipes of the bath fixture extend upwardly through the bottom wall. The apparatus further includes a waterproof covering that covers the entire inside surfaces of the compartment, and a drain element that connect the outlet of the bottom wall to a drain pipe of the bath fixture. The apparatus may also include at least one removable panel to provide access to water source pipes disposed within the compartment.

2 Claims, 1 Drawing Sheet

BATHROOM LEAK DAMAGE PREVENTION APPARATUS

BACKGROUND OF THE INVENTION

1. Field of the Invention

The present invention relates to plumbing fixtures and, more specifically without limitation, to connections to plumbing fixtures.

2. Description of the Related Art

Leaking pipes and shower/tub faucets can cause costly damage to walls, floors, and ceilings in lower levels. Such damage can result directly from water or be caused from mildew and mold buildup over time. Water damage, especially inside walls where a shower or bathtub is located, can often occur without the knowledge of the homeowner.

What is needed is a system that prevents damage from leaking connections to tub and shower fixtures.

SUMMARY OF THE INVENTION

The improvements for an apparatus for preventing water leak damage from a bath fixture, having a drain pipe connected to a drain port of the bath fixture and water source pipes connected to hot and cold inlet faucets and to a shower head of the bath fixture of the present invention, include a first side wall having a first side wall top edge, a first side wall bottom edge, and opposing first side wall end edges wherein the first side wall is positioned between the bath fixture and the plumbing connections connecting the water source to hot and cold inlet faucets and to the shower head of the bath fixture; a second side wall having a second side wall top edge, a second side wall bottom edge, and opposing second side wall end edges wherein the second side wall is positioned such that the plumbing connections connecting the water source to the hot and cold inlet faucets and to the shower head of the bath fixture are spaced between the first and second side walls; a first end wall extending from one of the opposing first side wall end edges to one of the opposing second side wall end edges and having a first end wall top edge connecting the first side wall top edge to the second side wall top edge and a first end wall bottom edge connecting the first side wall bottom edge to the second side wall bottom edge; a second end wall extending from the other one of the opposing first side wall end edges to the other one of the opposing second side wall end edges and having a second end wall top edge connecting the first side wall top edge to the second side wall top edge and a second end wall bottom edge connecting the first side wall bottom edge to the second side wall bottom edge wherein the first and second end walls are positioned such that the plumbing connections connecting the water source to the hot and cold inlet faucets and to the shower of the bath fixture are spaced between the first and second end walls; a top wall extending from the first side wall top edge to the second side wall top edge and from the first end wall top edge to the second end wall top edge; and a bottom wall extending from the first side wall bottom edge to the second side wall bottom edge and from the first end wall bottom edge to the second end wall bottom edge wherein the bottom wall slopes downwardly from each of the first and second side wall bottom edges and the first and second end wall bottom edges to an outlet. The first and second side walls, the first and second end walls, and the bottom wall define a compartment therebetween with the water source pipes of the bath fixture extend upwardly through the bottom wall.

The present invention includes a waterproof covering provided on the first and second side walls, the first and second end walls, the top wall, and the bottom wall including the junctures therebetween and the junctures between the water source pipes of the bath fixture and the bottom wall, and a drain element connecting the outlet of the bottom wall to the drain pipe of the bath fixture.

If it is foreseen that access may subsequently be needed to the water source pipes disposed within the compartment, an access panel may be provided for that purpose.

PRINCIPAL OBJECTS AND ADVANTAGES OF THE INVENTION

The principal objects and advantages of the present invention include: providing a system that prevents damage from leaking connections to tub and shower fixtures; and generally providing such a system that is reliable in performance, capable of long lasting life, and particularly well adapted for the proposed usages thereof.

Other objects and advantages of this invention will become apparent from the following description taken in conjunction with the accompanying drawings wherein are set forth, by way of illustration and example, certain embodiments of this invention.

BRIEF DESCRIPTION OF THE DRAWING FIGURES

DETAILED DESCRIPTION OF THE INVENTION

As required, embodiments of the present invention are disclosed herein, however, it is to be understood that the disclosed embodiments are merely exemplary of the invention, which may be embodied in various forms. Therefore, specific structural and functional details disclosed herein are not to be interpreted as limiting, but merely as a basis for claims and as a representative basis for teaching one skilled in the art to variously employ the present invention in virtually any appropriately detailed structure.

Figure 1:
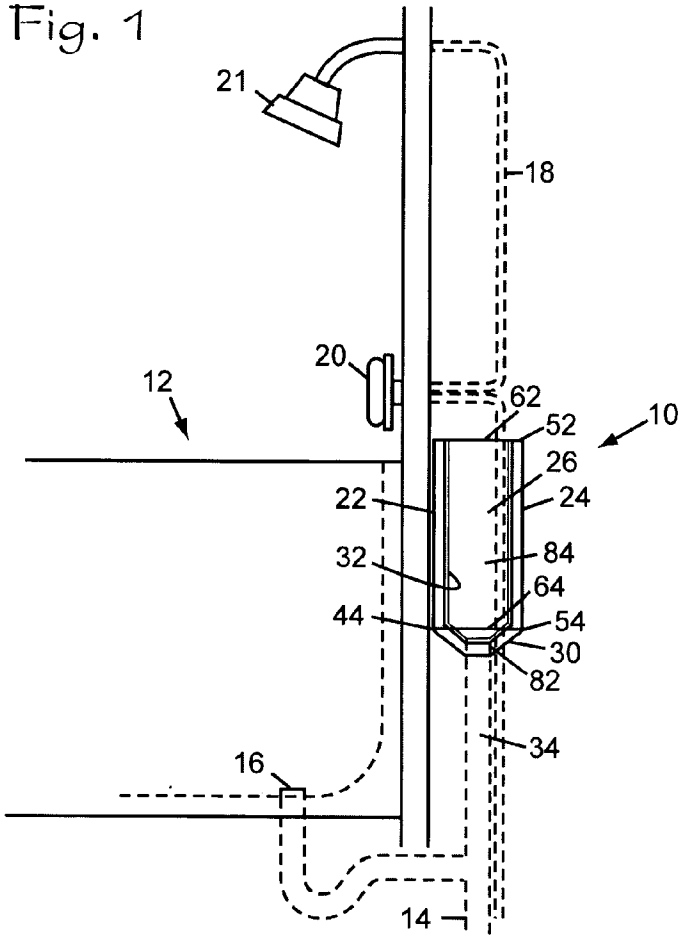
FIG. 1 is a perspective view of the bathroom leak damage prevention apparatus in accordance with the present invention.

The reference numeral 10 generally refers to an apparatus for preventing water leak damage from a bath fixture 12, having a drain pipe 14 connected to a drain port 16 of the bath fixture 12 and water source pipes 18 connected to hot and cold inlet faucets 20 and to a shower head 21 of the bath fixture 12, in accordance with the present invention as shown in FIG. 1.

The apparatus 10 of the present invention includes a first side wall 22, a second side wall 24, a first end wall 26, a second end wall 28, a top wall 29, a bottom wall 30, a waterproof covering 32, and a drain element 34.

The first side wall 22 has a first side wall top edge 42, a first side wall bottom edge 44, and opposing first side wall end edges 46 wherein the first side wall 22 is positioned between the bath fixture 12 and the plumbing connections connecting the water source pipes 18 to hot and cold inlet faucets 20 and to the shower head 21 of the bath fixture 12.

The second side wall 24 has a second side wall top edge 52, a second side wall bottom edge 54, and opposing second side wall end edges 56 wherein the second side wall 24 is positioned such that the plumbing connections connecting the water source pipes 18 to the hot and cold inlet faucets 20 and to the shower head 21 of the bath fixture 12 are spaced between the first and second side walls 22, 24.

The first end wall 26 extends from one of the opposing first side wall end edges 46 to one of the opposing second side wall end edges 56. The first end wall 26 has a first end wall top edge 62 connecting the first side wall top edge 42 to the second side wall top edge 52, and a first end wall bottom edge 64 connecting the first side wall bottom edge 44 to the second side wall bottom edge 54.

The second end wall 28 extends from the other one of the opposing first side wall end edges 46 to the other one of the opposing second side wall end edges 56. The second end wall 28 has a second end wall top edge 72 connecting the first side wall top edge 42 to the second side wall top edge 52, and a second end wall bottom edge 74 connecting the first side wall bottom edge 44 to the second side wall bottom edge 54, wherein the first and second end walls 26, 28 are positioned such that the plumbing connections 18 connecting the water source pipes 18 to the hot and cold inlet faucets 20 and to the shower head 21 of the bath fixture 12 are spaced between the first and second end walls 26, 28.

The bottom wall 30 extends from the first side wall bottom edge 44 to the second side wall bottom edge 54 and from the first end wall bottom edge 64 to the second end wall bottom edge 74 wherein the bottom wall 30 slopes downwardly from each of the first and second side wall bottom edges 44, 54 and the first and second end wall bottom edges 64, 74 to an outlet 82 wherein the first and second side walls 22, 24, the first and second end walls 26, 28, the top wall 29, and the bottom wall 30 define a compartment 84 therebetween and wherein the water source pipes 18 of the bath fixture 12 extend upwardly through the bottom wall 30.

Figure 2:
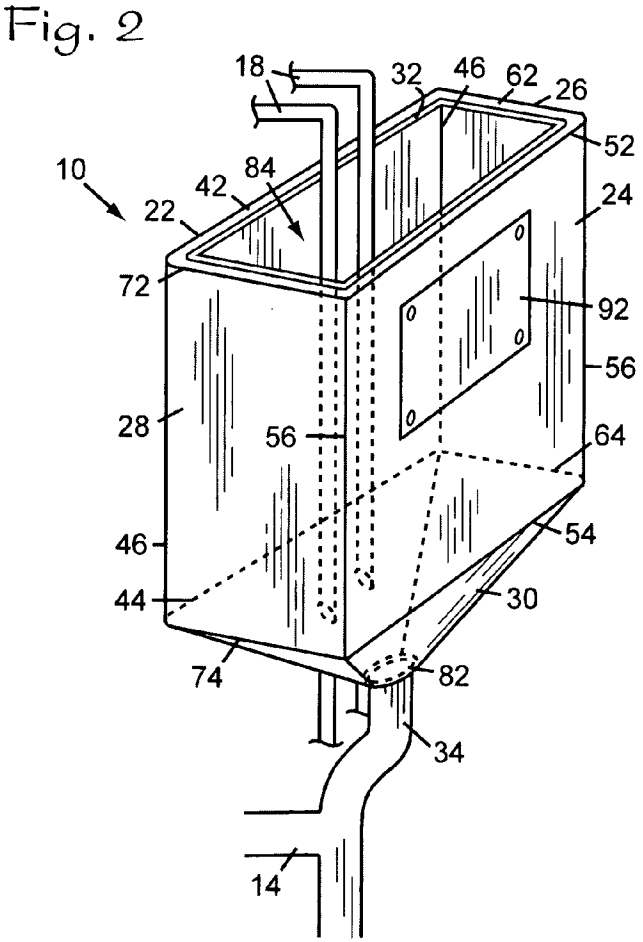
FIG. 2 is a cross-sectional, side elevational view of a bathroom leak damage prevention apparatus, taken along line 2-2 of FIG. 1, in accordance with the present invention.

The waterproof covering 32, shown fragmentary in FIG. 2 for purposes of clarity, is provided on the first and second side walls 22, 24, the first and second end walls 26, 28, the top wall 29, and the bottom wall 30 including the junctures therebetween and the junctures between the water source pipes 18 of the bath fixture 12 and the bottom and first side walls 26, 30.

The drain element 34 connects the outlet 82 of the bottom wall 30 to the drain pipe 14 of the bath fixture 12.

The apparatus 10 may also include at least one removable panel 92 in at least one of the first and second side walls 22, 24, the removable panel 92 being structured to provide access to portions of the water source pipes 18 of the bath fixture 12 disposed within the compartment 84.

In an application of the apparatus 10 of the present invention, the compartment 84, comprising the first and second side walls 22, 24, the first and second end walls 26, 28, the top wall 29, and the sloping bottom wall 30, is constructed around the water source pipes 18 connected to hot and cold inlet faucets 20 and to the shower head 21 of a bath fixture 12 such that the water source pipes 18 of the bath fixture 12 extend upwardly through the bottom wall 30. A waterproof covering 32 is provided on the entire inside surfaces of the compartment 84. A drain element 34 is provided to connect an outlet 82 in the bottom wall 30 to a drain pipe 14 of the bath fixture 12. If it is foreseen that access may subsequently be needed to the water source pipes 18 disposed within the compartment 84, an access panel 92 may be provided for that purpose.

It is to be understood that while certain forms of the present invention have been illustrated and described herein, it is not to be limited to the specific forms or arrangement of parts as described and shown.

What is claimed and desired to be covered by Letters Patent is:

1. An apparatus for preventing water leak damage from a bath fixture having a drain pipe connected to a drain port of the bath fixture and water source pipes connected to hot and cold inlet faucets and to a shower head of the bath fixture, the apparatus comprising:

(a) a first side wall having a first side wall top edge, a first side wall bottom edge, and opposing first side wall end edges wherein the first side wall is positioned between the bath fixture and the plumbing connections connecting the water source to hot and cold inlet faucets and to the shower head of the bath fixture;

(b) a second side wall having a second side wall top edge, a second side wall bottom edge, and opposing second side wall end edges wherein the second side wall is positioned such that the plumbing connections connecting the water source to the hot and cold inlet faucets and to the shower head of the bath fixture are spaced between the first and second side walls;

(c) a first end wall extending from one of the opposing first side wall end edges to one of the opposing second side wall end edges, the first end wall having:

(1) a first end wall top edge connecting the first side wall top edge to the second side wall top edge, and (2) a first end wall bottom edge connecting the first side wall bottom edge to the second side wall bottom edge;

(d) a second end wall extending from the other one of the opposing first side wall end edges to the other one of the opposing second side wall end edges, the second end wall having:

(1) a second end wall top edge connecting the first side wall top edge to the second side wall top edge, and (2) a second end wall bottom edge connecting the first side wall bottom edge to the second side wall bottom edge, wherein the first and second end walls are positioned such that the plumbing connections connecting the water source to the hot and cold inlet faucets and to the shower head of the bath fixture are spaced between the first and second end walls;

(e) a top wall extending from the first side wall top edge to the second side wall top edge and from the first end wall top edge to the second end wall top edge;

(f) a bottom wall extending from the first side wall bottom edge to the second side wall bottom edge and from the first end wall bottom edge to the second end wall bottom edge wherein the bottom wall slopes downwardly from each of the first and second side wall bottom edges and the first and second end wall bottom edges to an outlet wherein the first and second side walls, the first and second end walls, the top wall, and the bottom wall define a compartment therebetween and wherein the water source pipes of the bath fixture extend upwardly through the bottom wall;

(g) a waterproof covering provided on the first and second side walls, the first and second end walls, the top wall, and the bottom wall including the junctures therebetween and the junctures between the water source pipes of the bath fixture and the bottom wall; and (h) a drain element connecting the outlet of the bottom wall to the drain pipe of the bath fixture.

2. The apparatus as described in claim 1, further comprising at least one removable panel in at least one of the first and second side walls, the removable panel being structured to provide access to portions of the water source pipes of the bath fixture disposed within the compartment.

* * * * *